US008546673B2

(12) United States Patent
Peil

(10) Patent No.: US 8,546,673 B2
(45) Date of Patent: Oct. 1, 2013

(54) PERCUSSIVE ACCESSORY FOR STRING INSTRUMENT

(76) Inventor: Jesse Peil, Seattle, WA (US)

( * ) Notice: Subject to any disclaimer, the term of this patent is extended or adjusted under 35 U.S.C. 154(b) by 267 days.

(21) Appl. No.: 13/044,771

(22) Filed: Mar. 10, 2011

(65) Prior Publication Data

US 2011/0219934 A1 Sep. 15, 2011

Related U.S. Application Data

(60) Provisional application No. 61/313,660, filed on Mar. 12, 2010.

(51) Int. Cl.
*G10D 9/00* (2006.01)

(52) U.S. Cl.
USPC ..... 84/453

(58) Field of Classification Search
USPC ..... 84/453, 317, 318, 323
See application file for complete search history.

(56) References Cited

U.S. PATENT DOCUMENTS

| | | | | |
|---|---|---|---|---|
| 717,130 | A | 12/1902 | Steenbock | |
| 819,556 | A | 5/1906 | King | |
| 853,884 | A | 5/1907 | Kiessig | |
| 853,885 | A | 5/1907 | Kiessig | |
| 921,127 | A | 5/1909 | Lewis | |
| 921,565 | A | 5/1909 | Scarlett | |
| 2,429,138 | A | 10/1947 | Ruf | |
| 2,574,881 | A | 11/1951 | McBride | |
| 3,292,975 | A | 12/1966 | Hahnlein | |
| 3,293,975 | A * | 12/1966 | Koniecki | 84/320 |
| 3,623,390 | A | 11/1971 | Pitt, Jr. | |
| 4,195,546 | A * | 4/1980 | Urbank | 84/318 |
| 4,622,880 | A * | 11/1986 | Glemming et al. | 84/317 |
| 5,320,019 | A * | 6/1994 | McCaw | 84/323 |
| 7,674,971 | B2 * | 3/2010 | Saunders | 84/744 |

* cited by examiner

*Primary Examiner* — Jianchun Qin
(74) *Attorney, Agent, or Firm* — Richard C. Vershave; Foster Pepper PLLC

(57) ABSTRACT

A percussive device for a stringed instrument includes a support structure, an attachment component that attaches the support structure to the stringed instrument, one or more hammers attached to arms rotatably coupled to the support structure and one or more actuators. User activation of the actuators causes a corresponding one of the hammers to make contact with a string of the stringed instrument resulting in a rotational force applied to at least one of the hammer arms or actuators. The applied rotational force causes the hammer to be positioned out of contact with the string of the stringed instrument. The applied rotational force is overcome when an applicable force has been applied to the corresponding actuator by a user, thereby causing the hammer to contact a corresponding string of the stringed instrument.

6 Claims, 6 Drawing Sheets

PERCUSSIVE ACCESSORY FOR STRING INSTRUMENT

PRIORITY CLAIM

This application claims the benefits of U.S. Provisional Application Ser. No. 61/313,660, filed Mar. 12, 2010, the contents of which are hereby incorporated by reference.

BACKGROUND OF THE INVENTION

Many mechanical means have been provided in the past for use with guitars and similarly stringed instruments, but these means have been generally directed to simplifying the plucking of the strings by replacing manual plucking with mechanical plucking means. Examples of such means are those disclosed and described in U.S. Pat. Nos. 921,565 (Scarlett); 2,429,138 (Ruf); and 3,292,975 (Koniecki). Means have also been provided for changing the pitch of a string as it is plucked or strummed by lengthening or shortening the string, such as is disclosed and described in U.S. Pat. No. 2,574,881 to McBride.

No known means have been heretofore provided whereby the notes of a stringed instrument can be mechanically actuated like the strings in a piano.

SUMMARY OF THE INVENTION

The present invention provides a percussive device for a stringed instrument. The percussive device includes a support structure, an attachment component that attaches the support structure to the stringed instrument, one or more hammers attached to arms rotatably coupled to the support structure and one or more actuators rotatably coupled to the support structure. User activation of the one of the actuators causes a corresponding one of the hammers to make contact with a string of the stringed instrument.

In one aspect of the invention, a rotational force device applies a rotational force to at least one of the hammer arms or actuators. The rotational force device includes a torsion or helical compression spring. The applied rotational force causes the hammer to be positioned not in contact with the string of the stringed instrument. The applied rotational force is overcome when an applicable force has been applied to the corresponding actuator by a user, thereby causing the at least one hammer to be positioned in contact with the corresponding string of the stringed instrument.

In another aspect of the invention, the support structure includes two side sections that are located on either side of the strings of the stringed instrument when the device is attached thereto. The attachment component includes a strap received through one or more slots located in the support structure.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
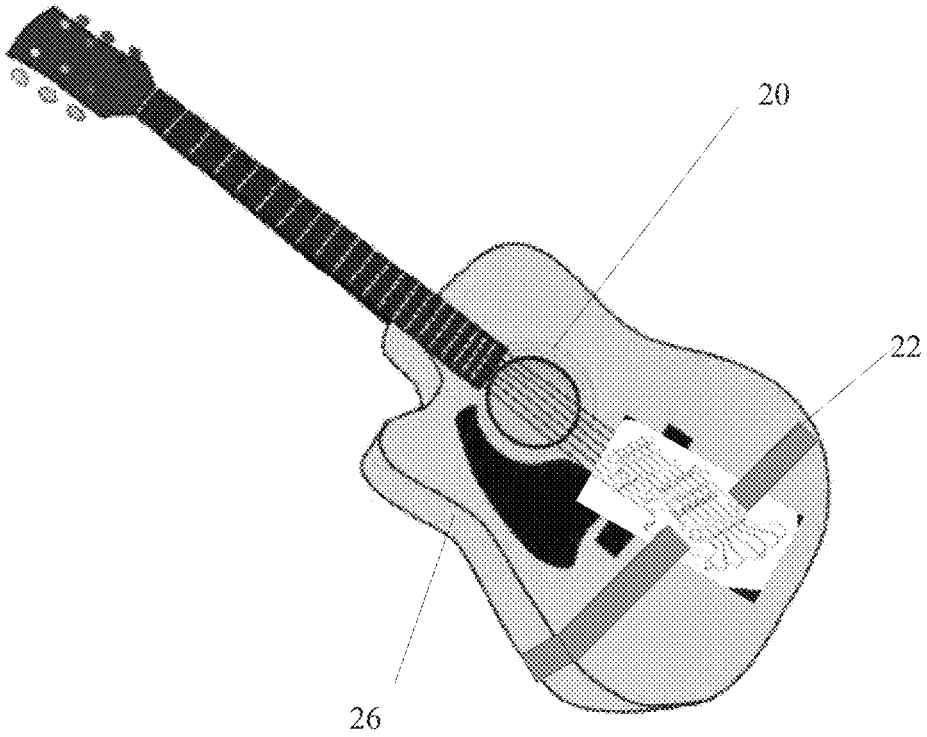
FIG. 1 is a perspective view of the present invention attached to a guitar.

FIG. 1 illustrates a perspective view of a guitar 22 and a percussive device 20 attached to the guitar 22 via a strap mechanism 26. When a user activates the percussive device 20, a percussive action is applied to the strings of the guitar 22, thereby producing a tone caused by vibration of the percussed strings.

Figure 2:
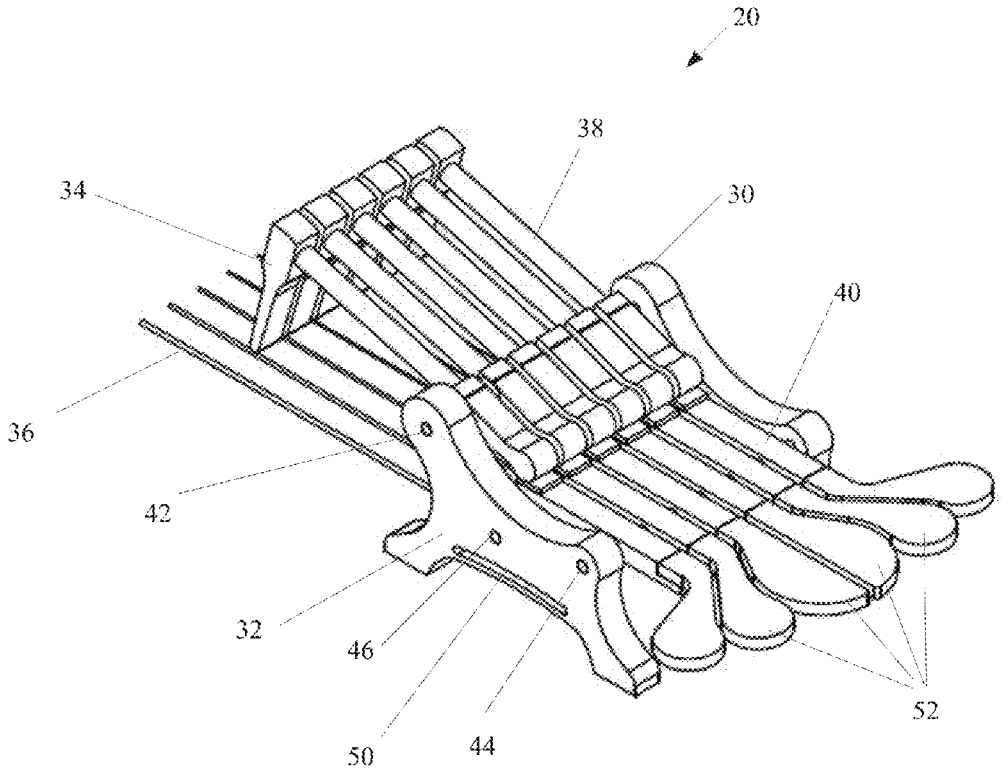
FIG. 2 is a perspective view of a percussive device formed in accordance with an embodiment of the present invention.

FIG. 2 illustrates a perspective view of the percussive device 20. The percussive device 20 includes first and second sides 30, 32 that are connected via crossbeams 42, 44, and 46. Rotatably mounted to the first crossbeam 42 are a plurality of hammer arms 38. Each of the hammer arms 38 includes a hammer head 34. The number of hammer arms 38 corresponds to the number of strings (six for the guitar 22) that the device 20 is to be attached to. Rotatably mounted to the second crossbeam 44 are a plurality of actuators 40 that are equal in number to the hammer arms 38. The third crossbeam 46 is located between the first and second crossbeams 42, 44. The third crossbeam 46 and the second crossbeam 44 are located lower on the sides 30, 32 than is the first crossbeam 42. The third crossbeam 46 is located below an interior end of the actuators 40, when the percussive device 20 is in an at-rest position. The third crossbeam 46 keeps the actuators 40 from coming in contact with the strings 36 of the guitar 22.

The percussive device 20 rests on the surface of the guitar 22 with legs of the side sections 30, 32 resting outside of the strings 36. No other portion of the percussive device 20 comes in contact with the strings 36 except for when the hammer heads 34 are activated by the user.

Interior ends of the hammer arms 38 come in contact with top surfaces of the interior ends of the actuators 40. Outboard ends of the actuators 40 include finger tabs 52 that extend beyond the frame of the sides 30, 32. The finger tabs 52 include larger surface areas than the portions of the actuators 40 located between the sides 30, 32, thereby allowing a user to make positive contact with the desired actuator.

Each of the sides 30, 32 includes a slot 50 for receiving the strap 26, as shown in FIG. 1, for attaching the percussive device 20 to a musical instrument. The slots 50 are located between legs of the sides 30, 32 and below the crossbeams 42, 44, and 46.

The percussive device 20 shown in FIG. 2 is in a relaxed position. This relaxed position is maintained by torsion springs (not shown) located where the actuators 40 make contact with the crossbeam 44 and where the hammer arms 38 make contact with the crossbeam 42. The torsion springs associated with the actuators 40 cause the actuators 40 to rotate so that the interior ends of the actuators 40 are forced to rest on the crossbeam 46. The torsion springs associated with the hammer arms 38 cause the hammer arms 38 to rotate so that an interior end of the hammer arms 38 is forced to come in contact with the respective interior ends of their associated actuators 40. When a user depresses one of the tabs of the actuator 40, the actuator 40 will rotate, thereby forcing the interior end of the actuator 40 in a vertical direction, thereby causing the respective hammer head 34 to rotate and, thus, make contact with the string that the hammer head 34 is above. Once the user has removed force from the tab 52, the percussion device 20 returns to the relaxed position.

Figure 3:
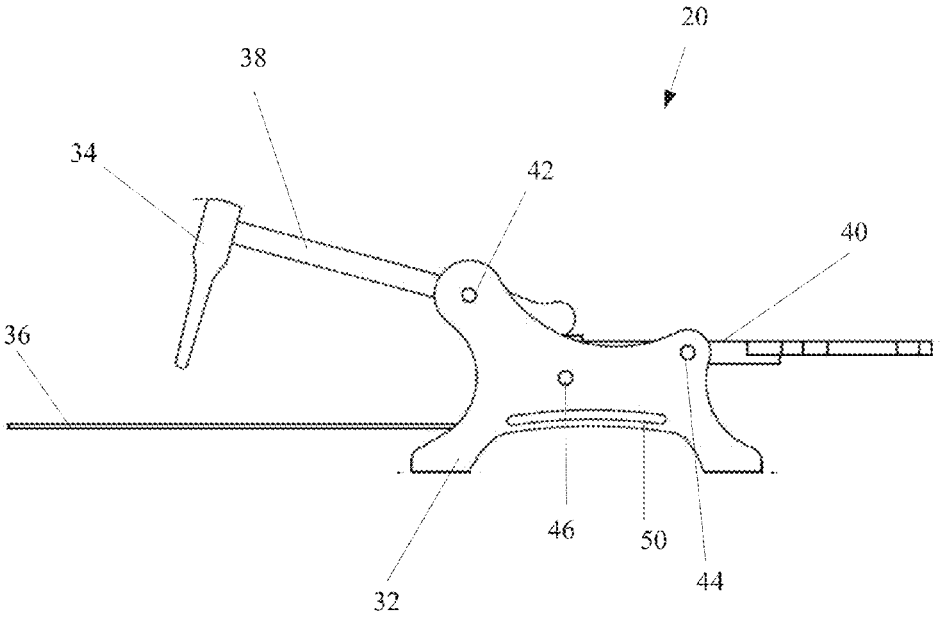
FIGS. 3 and 4 are side views of the device of FIG. 2 in different modes of operation.
Figure 4:
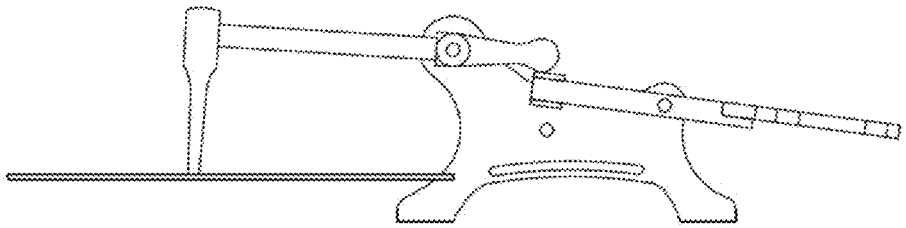

FIG. 3 shows a side view of the percussive device 20 in the relaxed position. FIG. 4 shows a side view of the percussive device 20 at the moment that the hammer head 34 strikes the respective string 36, as a result of activation of the associated actuator 40.

Figure 5:
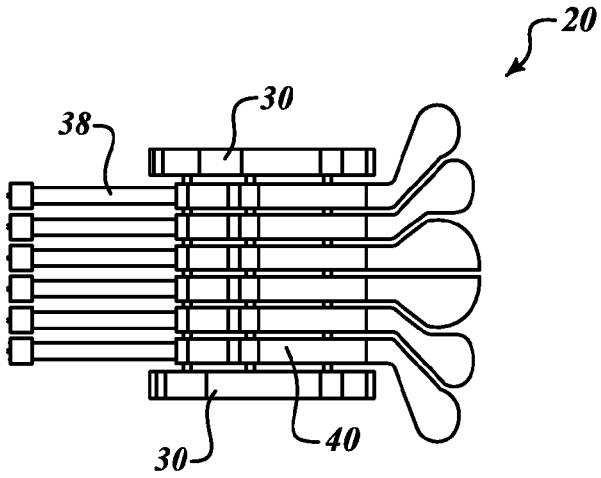
FIG. 5 is a top view of the device shown in FIG. 2.

FIG. 5 illustrates a top view of the percussive device 20 of FIGS. 1-4.

Figure 6:
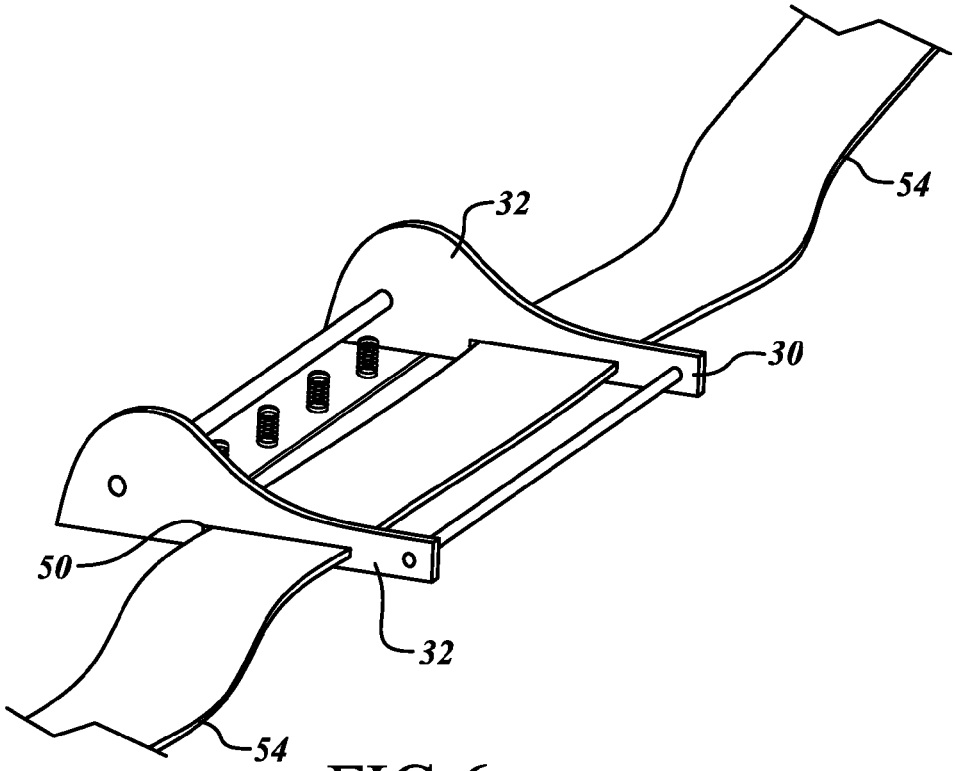
FIG. 6 is a perspective of an attachment device for the percussive device.

FIG. 6 illustrates a strap 54 that is received through the strap slots 50 of the sides 32, 30. In one embodiment, the strap 54 is long enough to wrap around the instrument and attach to itself using various types of attachment mechanisms, such as Velcro or snaps. In another embodiment, the strap 54 is attached directly to the instrument using some form of attachment mechanism. Other types of mechanisms are used for attaching the percussive device to the instrument, for example, suction cups. In another embodiment, a base is more permanently mounted to the instrument. The base does not include the working components of the percussive device. The working components of the percussive device and the base include an attachment device for allowing the working components to be quickly attached to the base. In another embodiment, a percussive device is built partially into the interior of the body of the guitar.

Figure 7A:
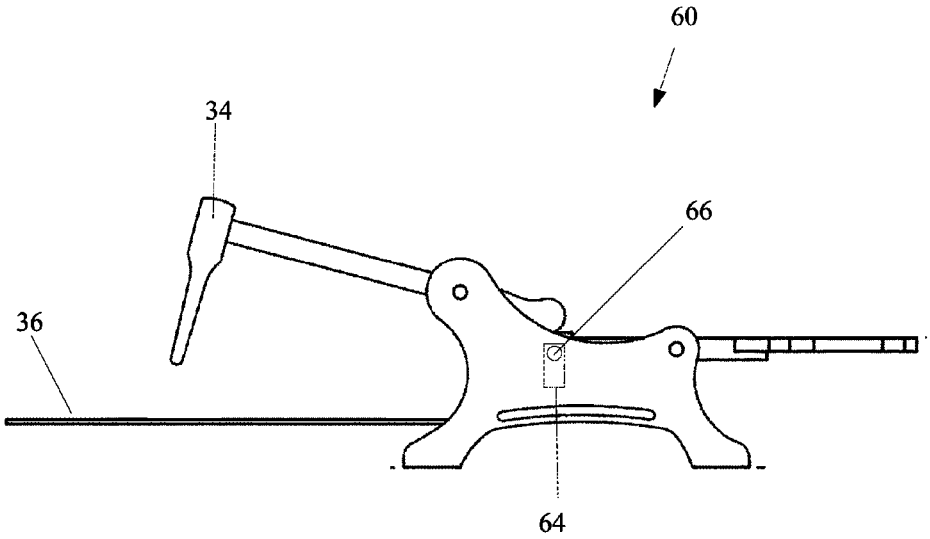
FIGS. 7A, B illustrate different operational modes in accordance with an embodiment of the present invention.
Figure 7B:
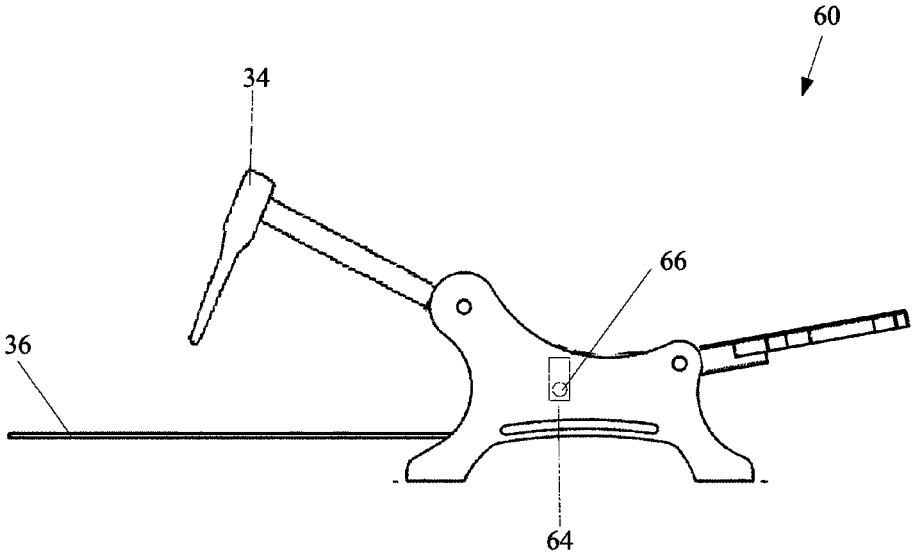

FIG. 7A illustrates a percussive device 70 in a first at rest position and FIG. 7B illustrates a percussive device 70 in a second at rest position. The difference in the at rest positions is the height of the hammer heads 34 above the strings 36. The height of the hammer heads 34 is controlled by the position of a crossbeam 66. The crossbeam 66 is supported in grooves 64 in the side sections. A securing device (not shown), such as a pin or geared dial, secures the crossbeam 66 so the crossbeam 66 doesn't move within the groove 64 after it has been set.

Figure 8:
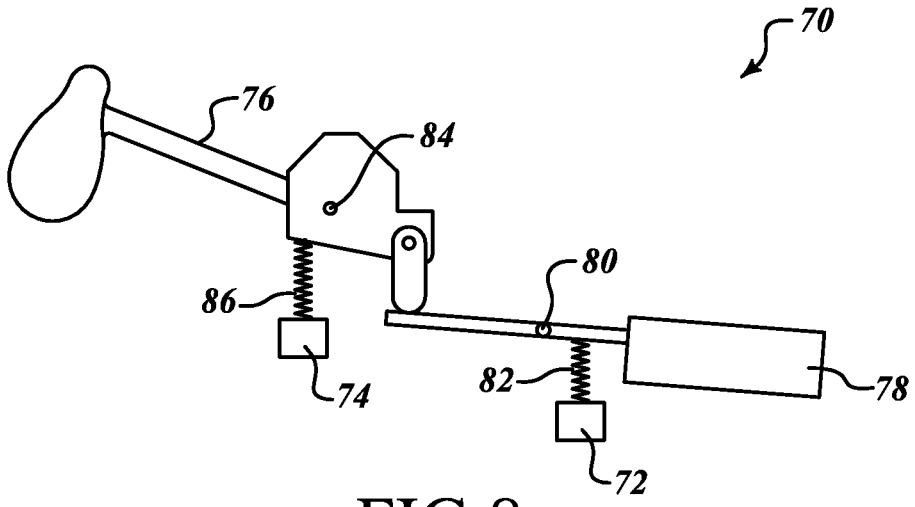
FIG. 8 is an x-ray side view of a percussive device formed in accordance with an alternate embodiment of the present invention.

FIG. 8 illustrates an x-ray side view of the operational portions of an exemplary percussive device 70. The sides of the device 70 are not shown. The percussive device 70 includes additional crossbeams 72, 74 located below actuators 78 and hammer arms 76 that rotate about crossbeams 80 and 84, respectively. These additional crossbeams 72, 74 have springs 82, 86 fixedly attached to a top surface of the crossbeams 72, 74. There is one spring 82, 86 located below each of the actuators 78 and the hammer arms 76. The springs 82, 86 are positioned such that the percussive device 70 will remain in the at-rest position, such as that shown in FIG. 3, when not being activated by a user. In other words, the force the springs 82, 86 apply to the actuators 78 and the hammer arms 76 is comparable to the force applied by the torsion springs in the embodiment shown in FIGS. 2-5.

Figure 9:
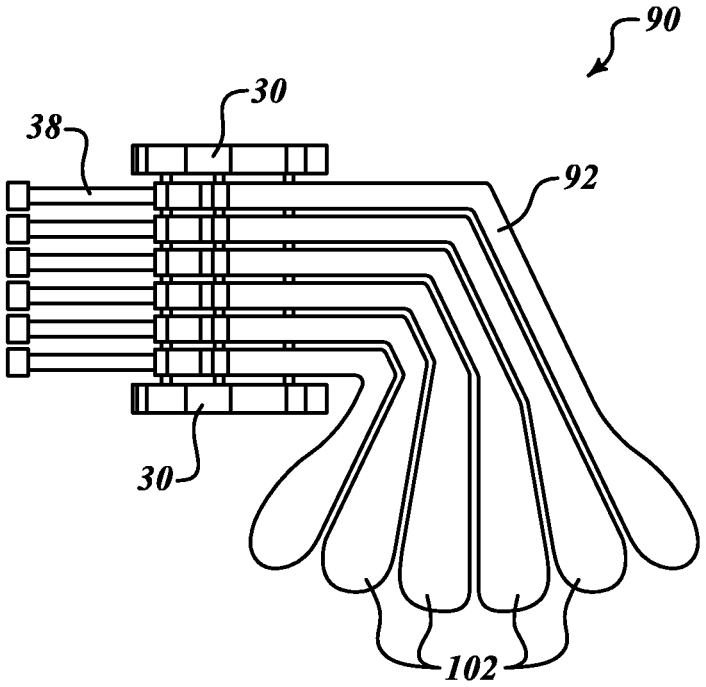
FIG. 9 is a top view of actuation members for the percussive device formed in accordance with an alternate embodiment of the present invention.

As shown in FIG. 9, a percussive device 90 includes actuators 92 that include outboard ends (tabs) 102 that fan out toward one side 30 of the percussive device 90. In this embodiment, the tabs 102 include a first end that is attached to the actuator or becomes the actuator. The tabs 102 fan out toward one of the sides 30 of the percussive device 90. This allows a user to activate the percussive device 90 from the side of the attached instrument instead of from the end of the instrument.

In one embodiment, the hammer arms are removable. The heads 34 can be made of a variety of different materials or combination of materials, for example various metals, woods, felt, rubber.

While the preferred embodiment of the invention has been illustrated and described, as noted above, many changes can be made without departing from the spirit and scope of the invention. For example, this invention may be scaled in size to be used with other stringed instruments, such as violin, cello, bass fiddle, etc. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A percussive device for a stringed instrument, the percussive device comprising:

a support structure;

an attachment component configured to attach the support structure to the stringed instrument;

one or more hammers attached to arms rotatably coupled to the support structure;

one or more actuators rotatably coupled to the support structure; and at least one rotational force device configured to apply a rotational force to at least one of the hammer arms or actuators, wherein the at least one rotational force device comprises at least one torsion spring or a helical compression spring, and the applied rotational force causes the at least one hammer to be positioned not in contact with the string of the stringed instrument;

wherein the attachment component comprises at least one of a strap received through one or more slots located in the support structure.

2. The device of claim 1 wherein user activation of the one of the actuators causes a corresponding one of the hammers to make contact with a string of the stringed instrument.

3. The device of claim 1 wherein the applied rotational force is overcome when an applicable force has been applied to the corresponding actuator by a user, thereby causing the at least one hammer to be positioned in contact with the corresponding string of the stringed instrument.

4. The device of claim 1 wherein the actuators comprise a user contact end and a hammer arm contact end, the hammer arm contact end maintains contact with the hammer arm when an applicable force has been applied to the corresponding actuator by a user.

5. The device of claim 4, wherein the user-contact end has a surface area that is greater than a surface area of the hammer arm contact end.

6. The device of claim 5, wherein the support structure comprises two side sections that are located on either side of the strings of the stringed instrument when the device is attached thereto, wherein the user-contact ends of the actuators extend beyond a width between the two sides of the support structure.

* * * * *